US007234219B2

(12) United States Patent
Deiter

(10) Patent No.: US 7,234,219 B2
(45) Date of Patent: Jun. 26, 2007

(54) ARROW REMOVAL TOOL AND METHOD FOR REMOVING ARROWS WITH AN ARROW REMOVING TOOL

(75) Inventor: Brian S. Deiter, 3215 Bingen Rd., Bothlehem, PA (US) 18015

(73) Assignee: Brian S. Deiter, Bethlehem, PA (US)

( * ) Notice: Subject to any disclaimer, the term of this patent is extended or adjusted under 35 U.S.C. 154(b) by 0 days.

(21) Appl. No.: 11/220,895

(22) Filed: Sep. 6, 2005

(65) Prior Publication Data

US 2006/0156524 A1 Jul. 20, 2006

Related U.S. Application Data

(63) Continuation of application No. 10/782,986, filed on Feb. 20, 2004, now abandoned.

(51) Int. Cl.
*B25B 27/14* (2006.01)

(52) U.S. Cl. ..... 29/426.5; 29/278

(58) Field of Classification Search ..... 30/120.3; 269/268, 239, 274; 29/278, 280, 282, 270
See application file for complete search history.

(56) References Cited

U.S. PATENT DOCUMENTS 4,073,418 A * 2/1978 Edson ..... 81/3.44
D436,300 S * 1/2001 Chiu ..... D7/680

* cited by examiner

*Primary Examiner*—Robert C. Watson
(74) *Attorney, Agent, or Firm*—Nils H. Ljungman & Associates

(57) ABSTRACT

An arrow extractor particularly useful for removing a broad-head or field head arrow embedded in a tree stump, three-dimensional target or other solid object and further designed to pull directly on the arrow shaft whereby such pulling force can be applied evenly and linearly and in parallel with the shaft of the arrow such that the likelihood of damage to the arrow is diminished. The arrow extractor includes two opposed hollowed out arrow grippers attached to pivoted lever arms through which gripping force is applied to the arrow shaft. A further benefit of the invention is that harmful forces are minimized upon the wrists and arms of the person using the device.

6 Claims, 9 Drawing Sheets

ARROW REMOVAL TOOL AND METHOD FOR REMOVING ARROWS WITH AN ARROW REMOVING TOOL

CONTINUING APPLICATION DATA

This application is a continuation of U.S. application Ser. No. 10/782,986, filed on Feb. 20, 2004 now abandoned.

BACKGROUND OF THE INVENTION

1. Field of the Invention

The present invention relates generally to archery accessories and more specifically to a tool or device for removing an impacted arrow from an archery target, the tool or device being particularly useful for removing an arrow that is embedded in a tree stump, three-dimensional target or other solid object. It is particularly useful for removing target arrows from prepared targets having a backing of corkboard, foam plastic material and the like which is frequently the case with modern archery targets.

2. Preliminary Discussion

Archery and archery hunting have a long history with roots extending back even to the hunter-gather days of human existence. The use of prepared artificial targets is also well known in the art and the use of extractors for the removal of embedded arrows from such targets is also well known in the prior art. However, new technologies applied in the field of archery have rendered obsolete many of these previously known methods and tools for extracting arrows from a target.

The modern compound bow differs significantly from the common recurve bows as well as from the compound bows of previous generations. With the unprecedented advances in the design and technology of the compound bow, such as single cams, parallel limbs, milled risers, machined pockets, low-stretch drawstrings, lubricated bow components, and the like, a modern compound bow can now easily propel an arrow through the air at a speed well in excess of 300 feet per second. A quality modern compound bow can thus easily propel any available broadhead-tipped arrow completely through a deer body and/or deeply into some other possibly unintended target. Similar advances in design and technology have been applied to the field of cross bows creating equally impressive arrow speed and impact energies.

However, technological advances in the field of archery have not been restricted to the bow or crossbow alone. Arrows now are made having shafts of lightweight aluminum or carbon fiber. Varieties of nickel-plated or stainless steel broadhead and target arrow tip designs are also available.

Yet, these advances in archery and archery equipment do not come cheaply. Rather they are expensive. For example, a dozen top quality carbon fiber arrows can cost in excess of $100.00. Moreover, each arrow requires a specialized broadhead or target arrow tip that can add $10.00 to $20.00 to the cost of each single arrow. Thus, a total investment for a dozen broadhead-tipped arrows can exceed $150.00 to $200.00. When the arrow has not landed in its intended fleshy target, the cost of each arrow makes imperative the ability to retrieve the arrow from its landing point without damaging the arrow itself or its striking end.

Retrieval of an arrow is no less complicated when the arrow is embedded in a foam practice target. The force expended against a foam target will frequently cause the arrowhead to become completely embedded or "submerged" in the target and leave only a portion of the arrow shaft itself exposed outside such foam target. The heat created by the friction between the arrow shaft and the foam target as the arrow passes through the target furthermore may frequently cause the foam to melt. After the arrow is completely stopped by the target, the foam will resolidify and adhere to the arrow shaft. This makes pulling or removing the arrow from the foam target for retrieval of the arrow even more difficult. Even with lubrication applied to the arrow shaft immediately before shooting, as is now frequently done, removing the arrow from the target is often a nearly impossible task, as pulling the arrow from the target usually requires extraordinary effort, strength and application of force. Moreover, pulling haphazardly on the exposed shaft of a carbon fiber arrow may frequently cause such arrow shaft to break.

The problem of retrieving an arrow from a foam practice target is even more complicated in winter when frost forms within the foam target. As the arrow strikes and passes through the frosted foam target, the heat created by friction between the arrow shaft and target frequently causes the frost surrounding the arrow shaft to instantaneously melt. After the arrow is stopped by the target, such moisture will then refreeze about the arrow shaft, thereby essentially locking the arrow in place and further complicating the process of removing such arrow from the foam target.

Those arrow extractors presently known in the art frequently fail to effectively remove an arrow from a target under the circumstance described above; that is, when used in an attempt to withdraw a carbon fiber arrow impacted in a foam target. Most present day extractors require one to remove the broadhead or arrow tip from the arrow shaft in order to use the extractor. Other extractors pull directly against the broadhead blades, which is impractical when the blade head is completely embedded in a target or when a so-called "field tip" having no blades is used on the arrow. Although some extractors are designed to pull on the arrow shaft, the force applied along the shaft exerted by such extractors is often neither linear nor uniform and thus the likelihood of breaking the arrow shaft becomes relatively high.

In summary, there is a need previously unmet in the prior art for a tool or device that can be used to remove a deeply embedded arrow from a target and wherein the arrow and arrow tip can be removed together from the target without requiring the removal of the arrow shaft from the arrowhead. Such tool or device should also not cause damage to the arrow shaft, nor allow the user to inadvertently make contact with the sharp point of a field tip or come into contact with the sharp blades of a broadhead type arrowhead.

The present invention satisfies this need in that the extractor of the present invention can be used to remove an arrow from a target without requiring the removal of the arrow shaft from the arrow tip and while minimizing the likelihood damage to the arrow or injury to the user.

3. Description of Related Art

Prior art in the relevant field of arrow extractors can be grouped broadly into three general categories. First, there are extractors that screw onto a broadhead after the arrow shaft is removed, usually by unscrewing the shaft from the head. Second, there are designs that pull directly upon the arrow without requiring the removal of the shaft from the head. Third, there are designs that comprise or provide an arrow extractor in combination with some other device, e.g. an arrow extractor which doubles as a bow stabilizer and/or tamping rod, etc. However, none of the prior art designs with which the inventor is familiar provide an arrow extractor that can be used to simply and easily remove an arrow from a target and particularly a deeply embedded arrow in which the arrow and arrow tip can be removed together from the target without removing the arrow shaft from the arrow tip while also diminishing the likelihood of damage to the arrow shaft or injury to the user.

The first category of prior art references include arrow extractors that screw onto a broadhead or other arrowhead after the arrow shaft is removed. Examples include U.S. Pat. No. 3,890,692 issued to Jandura, Jr. on Jun. 24, 1975 entitled "Process and Apparatus for the Removal of Arrow", which discloses an extractor having a handle with a threaded end. The handle is screwed upon the arrowhead after the arrow shaft is removed. A second reference, U.S. Pat. No. 4,043,020 issued to Hoggard on Aug. 23, 1977 entitled "Arrowhead Extractor," discloses a linearly slideable hammer on a shaft that may be screwed onto the arrowhead after the arrow shaft is removed. A third reference, U.S. Pat. No. 4,125,927 issued to Geary on Nov. 21, 1978 entitled "Embedded Arrowhead Retrieving and Multipurpose Tool," discloses an extractor making use of a flexible cable, a threaded end that may be screwed onto an arrowhead, plus a hammer block that may slide against a stop on the cable to exert rearward hammer force on the arrowhead. A fourth reference, U.S. Pat. No. 4,633,562 issued to Ulsh on Jan. 6, 1987 entitled "Arrowhead Extractor," discloses an extractor having a long threaded rod with a threaded turnbuckle engaged with its outer surface and having a hollow retainer to draw the threaded rod through its bore and with a threaded axial bore at one end for attachment to an arrowhead, A fifth reference, U.S. Pat. No. 4,920,625 issued to Smith on May 1, 1990 entitled "Arrowhead Extractor." discloses an extractor having a threaded shaft at one end and a handle at its opposite end. Rotation of the shaft exerts outward pressure to extract the arrowhead. A sixth reference, U.S. Pat. No. 5,102,100 issued to Troncoso, Jr. on Apr. 7, 1992 entitled "Archery Arrowhead Puller Device," discloses an extractor comprising an adjustable pulling bar and lever handle exerting force against a support bar by a second class lever action. A seventh reference, U.S. Pat. No. 5,205,541 issued to Roberts et al on Apr. 27, 1993 entitled "Arrowhead Extractor," discloses an extractor having a threaded end, a central pivot, and a lever arm which exerts pulling force against an embedded arrowhead by a first class lever action. The extractor is connected to the arrowhead at its threaded end. An eighth reference, U.S. Pat. No. 5,301,924 issued to Kammerer on Apr. 12, 1994 entitled "Arrowhead Puller," discloses an extractor similar to U.S. Pat. No. 5,205,541, but having an adjustable length at its central point. A ninth reference, U.S. Pat. No. 5,408,734 issued to Mills et al. on Apr. 25, 1995 entitled "Arrowhead Extractor," discloses an extractor having a barrel, a threaded extractor shaft and an internally threaded collar insert. The shaft is threaded onto the shank of an arrowhead after the arrow shaft is removed. A tenth reference, U.S. Pat. No. 5,416,963 issued to Boynton on May 23, 1995 entitled "Arrow Tip Remover," discloses a bolt having a threaded bore and a sleeve having a hexagon head whereby the sleeve may be placed around an arrow tip and the bolt fittingly placed inside the sleeve for attachment to the arrow tip for removal by rotation of the threaded member. An eleventh reference, U.S. Pat. No. 5,468,034 issued to Kopel on Nov. 21, 1995 entitled "Apparatus for Pulling Arrows from Surfaces in Which They are Embedded," discloses an extractor comprising a threaded bore having a T handle, whereby the extractor may be attached to the shank of an embedded arrowhead, and the embedded arrowhead may pulled loose simply by application of manual force. A twelfth reference, U.S. Pat. No. 5,504,982 issued to Sharp on Apr. 9, 1996 entitled "Embedded Arrowhead Removing Tool" discloses a sliding hammer mounted upon a rod that may be screwed upon the shank of an arrowhead to loosen an embedded arrowhead. A thirteenth reference, U.S. Pat. No. 5,621,957 issued to Herrera et al. on Apr. 22, 1997 entitled "Arrowhead Extraction Tool," discloses an arrow extractor having two threaded rods connected by a crossbar. The operation is analogous to a gear puller and includes a pulling mechanism which may be screwed onto the shank of an arrowhead after the arrow shaft is removed. A fourteenth reference, U.S. Pat. No. 6,148,492 issued to Gaulden on Nov. 21, 2000 entitled "Extractor for Arrowhead," discloses an arrowhead extractor comprising a C-shaped fork with protruding prongs further having a threaded center shaft for attachment to the embedded arrowhead and functionally similar to the Herrera et al. patent.

The second category of prior art references includes arrow extractors designed in combination with some other device such as a bow stabilizer. Examples are U.S. Pat. No. 4,169,454, U.S. Pat. No. 4,387,697, U.S. Pat. No. 4,584,983, U.S. Pat. No. 4,748,965, U.S. Pat. No. 4,907,567, U.S. Pat. No. 4,957,095, and U.S. Pat. No. 5,934,001, which all disclose a bow stabilizer that may be screwed onto a lodged arrowhead such that the arrowhead may be pulled and dislodged by prying or pulling on the stabilizer device now used as a handle to extract the arrowhead.

However, arrow extractors that are designed for use after removing the arrow shaft from the broadhead or other arrowhead cannot be used where the broadhead is completely embedded in a target below the surface of such target, because the head of the arrow is not accessible when the head is embedded or submerged in the target. Removing the arrow shaft and connecting the extractor to the embedded broadhead or other arrow tip is nearly impossible where access to the arrowhead is limited by the surrounding target material. In addition, where an arrow is impacted in a foam target, unscrewing of the arrow shaft from the head is impractical because the foam target will often have melted and/or frozen about the arrow shaft. Another disadvantage of all extractors in this category is the required additional operations of unscrewing the shaft from the arrowhead and of reinstalling the arrowhead to the arrow shaft before reuse of the arrow. The references in the first and second categories of references listed above do not suggest or disclose an arrow extractor that can be used to remove an arrow from a target whereby the arrow and head can be removed together from the target without removing the arrow shaft from the head and also minimizing the likelihood of damaging the arrow shaft.

There are relatively few prior art extractors in the last category of references, i.e. arrow extractors that are designed to pull directly upon the broadhead or arrow without requiring the removal of the arrow shaft from the arrow tip. Examples include U.S. Pat. No. 5,546,621 issued to Bulot on Aug. 20, 1996 entitled "Arrow-Out" which discloses an arrow extractor with two pivoting handles forming together a cylindrical grip, each cylindrical grip having an elongated groove and further having a rubber liner in each elongated groove, whereby the handles may be pressed upon the shaft of an arrow and the arrow and head may be pulled together from its impact location.

U.S. Pat. No. 5,544,926 issued to Ravencroft on Aug. 13, 1996 entitled "Shaft Gripper for Pulling an Arrow" discloses an elongated grip member made of a flexible rubbery material and further having a V-shaped groove cut lengthwise therein. The grip is placed along the arrow such that the shaft will lie within the groove of the device. The grip is then squeezed upon the arrow shaft and head so they may be pulled together from their impact location.

U.S. Pat. No. 3,828,471 issued to Orton et al. on Jul. 30, 1974 entitled "Device for Pulling Arrowheads from Implantation in Solid Objects" discloses an extractor having a pivoting lever and a retaining cam. A blade of the arrowhead is fitted against the cam and the cam pressure is increased as the lever is engaged such that the arrowhead may be dislodged from its location. However, this device cannot be used when the broadhead is completely embedded or submerged in a target or other landing or impact location.

U.S. Pat. No. 3,873,068 issued to Allen on Mar. 25, 1975 entitled "Archer's Accessory Tool for Removing Embedded Arrowheads" discloses an extractor comprising a fulcrum lever having a pair of protruding lugs that fit into the corresponding spaces in the arrowhead. The arrowhead is dislodged as the lever is applied. This device can not be used when the broadhead is completely embedded or submerged in a target or landing location.

None of the aforementioned references in any category suggest or disclose an extractor designed to pull directly on the arrow or arrow shaft whereby such pulling force can be applied evenly and linearly and in parallel with the shaft of the arrow such that the likelihood of damage to the arrow is minimized or diminished. A further benefit of the present invention is that potentially harmful forces are minimized upon the wrists of the person using the device, because a person using the present invention can pull the arrow from the target without bending his or her wrists and can do so by a straight outward or backward pull with one or both hands. Additionally, because the present invention maintains a solid grip upon the arrow, the present invention allows the user to apply a turning or rotational action, or in effect spin the arrow shaft within the target, and thereby loosen the arrow shaft from a frozen position within the foam target. This spinning or turning action is especially important where the target material has melted and then frozen about the arrow shaft either by melting and resolidification of a foam plastic target material about the arrow or in cold weather where the target material such as foam plastic or cork-type material has absorbed moisture which has then frozen. In such case melting of the ice formed by freezing of such moisture will as a result of impact energy released by the arrow followed by immediate refreezing of such moisture frequently cause the arrow to be directly adhered to the target material.

OBJECTS OF THE INVENTION

It is therefore a primary object of the invention to provide an arrow extractor that can be used to remove an arrow from a target whereby the arrow shaft and arrowhead can be removed together from the target without requiring the removal of the arrow shaft from the head.

Similarly, it is a primary object of the invention to provide an arrow extractor that can be used where the broadhead or tip of the arrow is completely embedded or submerged in a target.

Similarly, it is a still further primary object of the invention to provide an arrow extractor that does not cause damage to the arrow shaft during extraction from a target.

Similarly, it is a still further primary object of the invention to provide an arrow extractor that can be used with a modern lightweight aluminum and carbon fiber arrow.

Similarly, it is a still further primary object of the invention to provide an arrow extractor that can be used with all modern broadhead designs and arrow tips.

Similarly, it is a still further primary object of the invention to provide an arrow extractor that minimizes any harmful effect on the wrists and arms of the person using the device.

Still another object of the invention is to provide an arrow extractor designed to pull directly on the arrow shaft whereby such pulling force can be applied evenly and linearly or in parallel with the shaft of the arrow.

Still another object of the invention is to provide an arrow extractor that firmly grips the arrow shaft, such that a turning force can be applied to the arrow shaft, thereby freeing the arrow from any melted and resolidified or refrozen area surrounding the arrow shaft as it rest embedded in a foam practice target.

Still another object of the invention is to provide an arrow extractor that minimizes the pulling force required to remove an embedded arrow from its target.

Still another object of the invention is to provide an arrow extractor that can be used when only a portion of the arrow shaft may be exposed outside the target.

Still another object of the invention is to provide an arrow extractor that can be used to remove an arrow from an unintentional target, such as a tree, tree stump or other solid object.

Still another object of the invention is to provide an arrow extractor that can be used without stripping away portions of bark or wood for access to the arrow or arrowhead and thereby minimize any damage to trees and forests.

Still another object of the invention is to provide an arrow extractor that does not require the user to handle or make contact with the arrow near the sharp point of an arrow tip or the sharp blades of the broadhead.

Still another object of the invention is to provide an arrow extractor that can be used with decreased risk to the user of being cut or otherwise injured by the broadhead or arrow tip.

Still another object of the invention is to provide an arrow extractor that can be inexpensively and easily manufactured and marketed.

Still another object of the invention is to provide an arrow extractor with essentially all of the advantages of the designs and configurations known in the prior art plus few or none of the disadvantages.

Still another object of the invention is to provide an arrow extractor having dimensions and a shape that can be simultaneously clamped on an arrow and pulled straight back by either one or two hands and particularly with the fingers of one hand curled around the levers of the extractor on both sides of the clamp to attain an even back force, or rearward pull, upon the clamp member.

Still other objects and advantages of the invention will become clear upon review of the following detailed description in conjunction with the appended drawings.

SUMMARY OF THE INVENTION

The foregoing objects are attained in the present invention in a tool or device having a pair of pivoting arms, each arm having a semicylindrical channel member mated perpendicularly thereto and symmetrically in relation to the channel member of the opposite arm, such that the arms may be closed upon the shaft of an arrow embedded in a target whereby the shaft of the embedded arrow will lie evenly within the recess of each semicylindrical channel. A resilient gripping or padding composition lines each semicylindrical channel to provide intimate friction contact with the arrow shaft. A closing or squeezing force upon the pivoting arms causes the semicylindrical channel to engage tightly about the shaft of the embedded arrow, such that the arrow may be pulled from its embedded location using both an outward force and if necessary a twisting motion upon the arrow shaft applied through the tool.

DESCRIPTION OF THE PREFERRED EMBODIMENTS

Figure 1A:
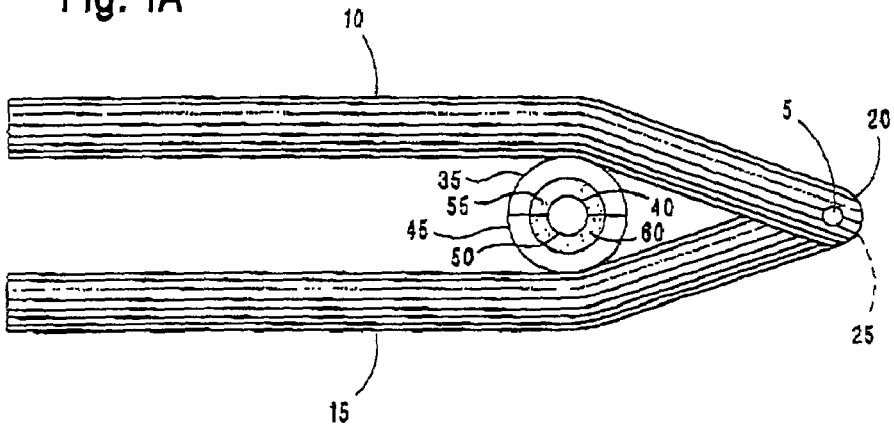
FIG. 1A is a lateral or side view of the arrow extractor of the present invention in a normal operating position as it would be closed around an arrow for removing such arrow impacted essentially horizontally into a vertical target, but without showing the arrow.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Through the years there have been numerous arrow extractors devised for removing arrows from targets, both inanimate and animate. Many of these have depended upon the removal of the arrow shaft from the arrow head followed by threading the extractor onto the arrowhead followed by the exertion of rearward tension on the arrowhead to remove it. Other extractor devices have depended on hand grippers in the form of clamping sections to exert backward force upon the arrow shaft. While the prior devices have operated with various efficiencies, none has been completely satisfactory.

In accordance with the present invention, a pair of cylindrical clamps are positioned directly about the shaft of an arrow impacted or embedded into a target somewhat as has been done before. However, in accordance with the improvement of the invention, the cylindrical clamps are mounted upon and brought together by two lever arms connected to each other at one end with the lever arms extending to the other side of the cylindrical clamps. The leverage of such arms enables a very secure grip to be obtained on the arrow shaft and, in addition, having the clamping sections located intermediate of the opposite ends of such lever arms enables a secure grip to be manually obtained on both ends of the lever arms if necessary so that not only may a more powerful handgrip be applied to the arrow shaft in combination with a powerful reverse pull away from the target, but there is considerable less tendency for the application of an uneven lateral force to the arrow shaft, since any uneven force could serve to snap some modern relatively strong, but brittle, arrow shafts. Even if only one hand applies a backward pull against an arrow to extract it from a target holding only the outwards ends of the lever arms, because the actual clamp members are disposed on the same side of the pivot point as the lever arms, or "inside" the pivoting arms, a more uniform direct outward force tends to be applied to the arrow shaft considerably reducing the possible tendency to damage such shaft. In addition, because of the small dimensions of the arrow extractor, one hand can be applied with the fingers on opposite sides of the clamp sections to withdraw an arrow evenly straight back from a target. Furthermore, a relatively great rearward force is applicable with only a small light tool or extractor which small, light extractor can easily be carried in the user's pocket or in a small belt holster or the like. Having the two clamping members positioned more or less centrally of the two lever arms also produces a more compact overall tool increasing both its pocketability and general transportability and convenience. The improved arrow extractor of the invention constitutes, therefore, a significant improvement in the art of tools for extracting arrows from archery and particularly archery hunting targets. Moreover, the small size or dimensions of the arrow extractor of the invention allow the archer to easily grasp the arrow extractor with one hand in a completely balanced fashion and place rearward or twisting force to the arrow shaft with essentially no sidewise or lateral force which might bend or possibly break the arrow shaft.

Figure 2E:
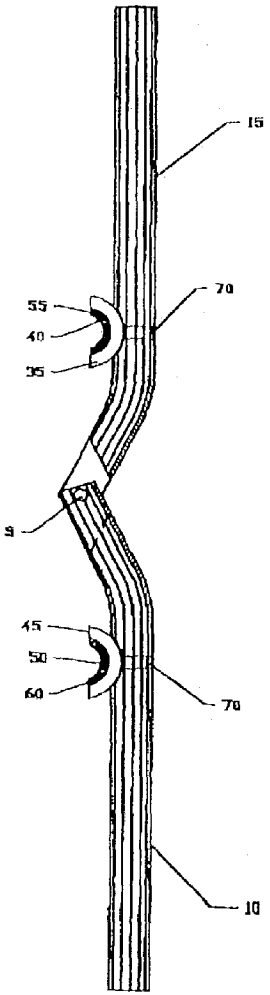
FIG. 2E is a side view of the arrow extractor of the invention laid out in a fully open position as in FIG. 2A.
Figure 2A:
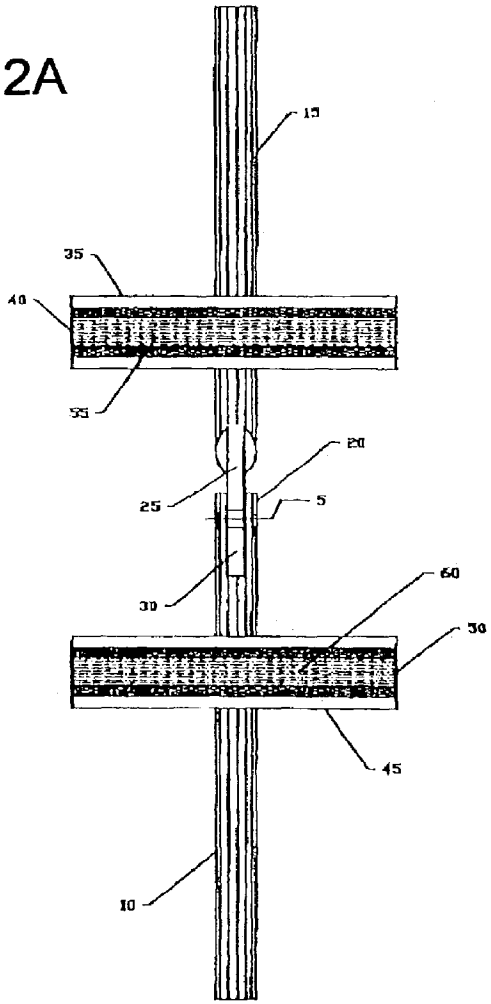
FIG. 2A is a top or plan view of the arrow extractor of the present invention laid out in a fully open position.
Figure 2B:
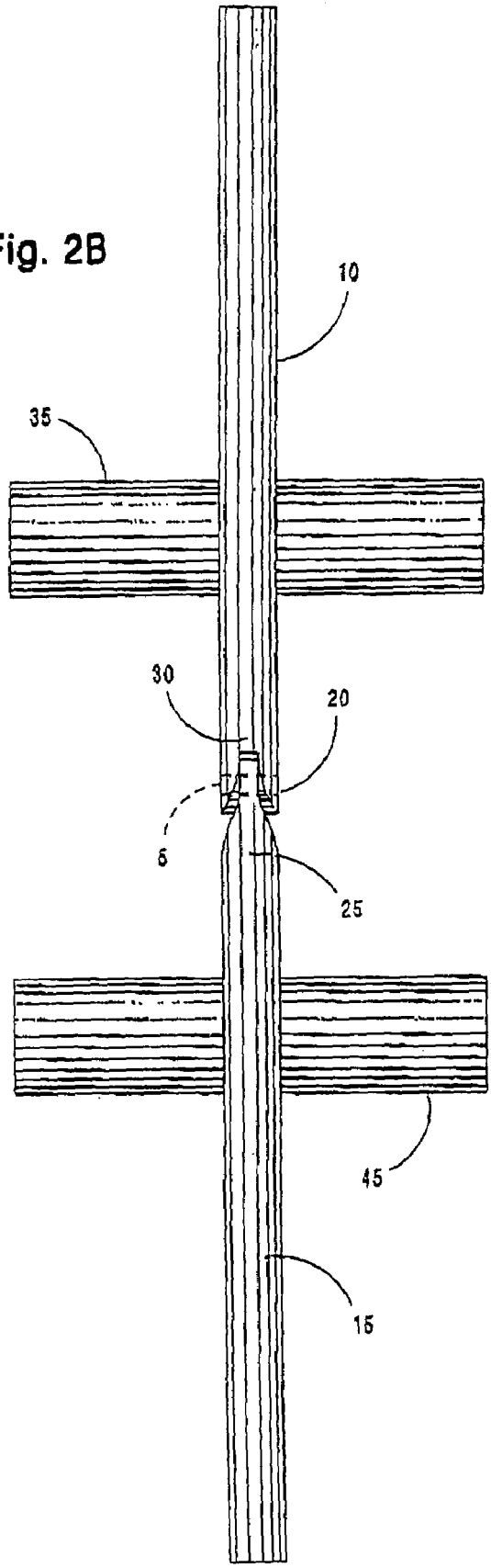
FIG. 2B is a bottom view of the arrow extractor of the invention laid out in a fully open position.

Referring to FIG. 1A, which is an elevation of a side of the arrow extractor of the present invention when oriented in the usual operating position, the extractor of the invention is depicted as having a first lever arm 10 with a female hinge fork 20 at one end and a second lever arm 15 with a male hinge protrusion 26 at one end (see FIGS. 2A and 2B). The male hinge protrusion 25 shown in FIGS. 2A and 2B is fitted into and retained in the female hinge fork 20 by a hinge pin 5, which hinge pin 5 connects the first lever arm 10 with the second lever arm 15 creating at one end an overall V-shaped frame. A recess 30 in the female hinge fork 20 surrounds the male hinge protrusion 25 of the second lever arm 15 such that the first lever arm 10 and the second lever arm 15 may be preferably fully opened 180-degrees and almost fully closed without interference in the female hinge fork 20 of the first lever arm 10.

Connected to the first lever arm 10 is a first arrow shaft gripper or clamp member 35 having a first arrow accommodating groove 40 and a first groove liner 55. The first groove liner is preferably made of rubber or other suitable pliable or resilient friction or grip enhancing material. Similarly situated on the second lever arm 15 is a second arrow shaft gripper or clamp member 45 such that when the first lever arm 10 is brought to a closure position or pivots toward the second lever arm 15, the first arrow shaft gripper or clamp member 35 will close upon and/or meet with the second arrow shaft gripper or clamp member 45. The second arrow shaft gripper member 45 has a second arrow groove 50 and a second groove liner 60, configured in the same manner as the first arrow shaft gripper member 35, first arrow groove 40 and first groove liner 55.

The first and second lever arms 10, 15 are made of a suitable material, preferably a lightweight oxide-resistant metal such as aluminum, magnesium-aluminum or the like such that the lever arms 10, 15 may withstand the closing force placed upon them in the gripping and pulling of a lodged arrow but are still relatively light. The first and second arrow grippers 35, 40 are made of a similarly suitable lightweight metal, which is preferably the same material as used in the first and second lever arms 10, 15. Further, the first and second lever arms are of sufficient overall length, ideally 6-7 inches, such that the device can be easily held and gripped in use while dislodging an arrow. A lever arm length of less than 5 inches renders the device hard to grasp and use whereas lengths greater than 8 inches renders the device more cumbersome than is otherwise necessary. It is desirable for the extractor tool to be small enough to be easily carried in the pocket of the user or in a small holster attached to the users belt. The first and second lever arms 10, 15 are preferably not straight but concavely curved in relation to the attached arrow shaft grippers, thus to facilitate closure of the arrow shaft grippers 35, 45 straight upon each other without interference from either lever arm 10, 15. Such shape also facilitates gripping of the entire device with one or both hands. As shown such concavity or curvature is positioned at the point where the clamp sections 35 and 45 are attached to the lever arms by any suitable means. However, the curvature of the lever arms 10 and 15 could be positioned closer to the pivot point of the lever arms away from the clamp sections.

The first and second arrow shaft grippers 35, 45 may be attached to their corresponding or correlating lever arms by the use of welding, brazing, recessed machine screws, or any other suitable connecting or attachment means. Alternatively, a lever arm and its correlating arrow shaft gripper, or clamp section, could be machined from a common piece of metal stock, although in most cases this would be unduly costly. Preferably, the first and second arrow shaft grippers 35, 45 are attached or connect to their correlating lever arm at preferably no less than ¼ the overall length of their corresponding lever arm and at an end closest to the hinge pin 5. Preferably the grippers would be positioned no more than about one third of the overall length of the lever arms from the pivot point of the two arms. This facilitates the provision of ample length for gripping the device at both sides adjacent to the arrow shaft grippers, or clamp sections, 35, 45 without sacrificing clamping pressure. Alternatively, and less desirably the first and arrow shaft grippers 35, 45 may be attached to their respective lever arms 10, 15 near the middle of each lever arm for easier gripping of the device with two hands.

The first and second arrow shaft grippers, or clamp sections, 35, 45 should be of sufficient length so as to adequately grip the arrow but not so long as to become ineffective in a case where only a few inches of the arrow shaft remains protruding from the target. Ideally, the length of each arrow shaft gripper 35, 45 should be the same and not less than 2 inches nor more than about 5 inches in length.

Without respect to the male and female hinge components 20, 25, the device is preferably largely symmetrical with respect to the first and second lever arms 10, 15. That is, notwithstanding the female hinge fork 20, male hinge protrusion 25 and recess 30, which must, of course, be different in order to mesh correctly, the second lever arm and the components attached thereto are largely a mirror image of the first lever arm and the components attached thereto.

Figure 1B:
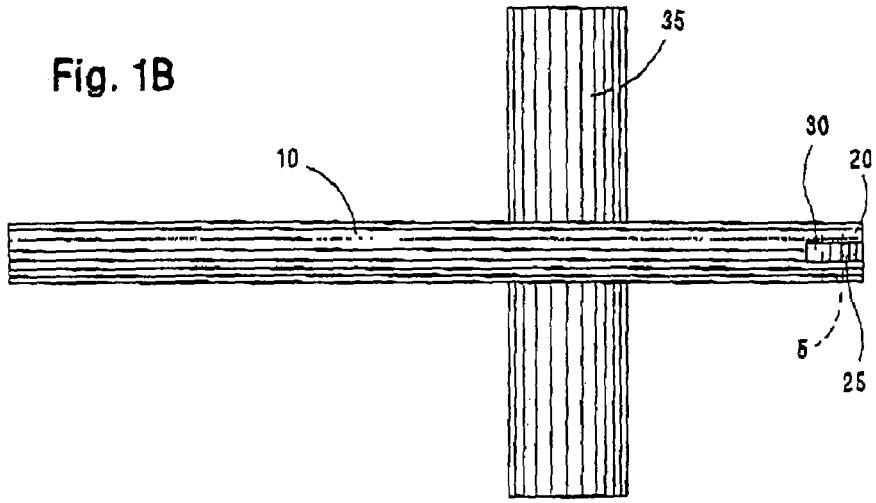
FIG. 1B is a plan or top view of the arrow extractor of the present invention in a closed position and also in the normal operational position shown in FIG. 1 for an arrow impacted or embedded into a vertical target, also without showing the arrow.

FIG. 1B is a plan or top view of the present invention, as if being used on an arrow extending more or less horizontally from a target, in a closed operating position depicting the first lever arm 10 and its female hinge fork, A top view of the first arrow shaft gripper 35 is also shown.

Figure 1C:
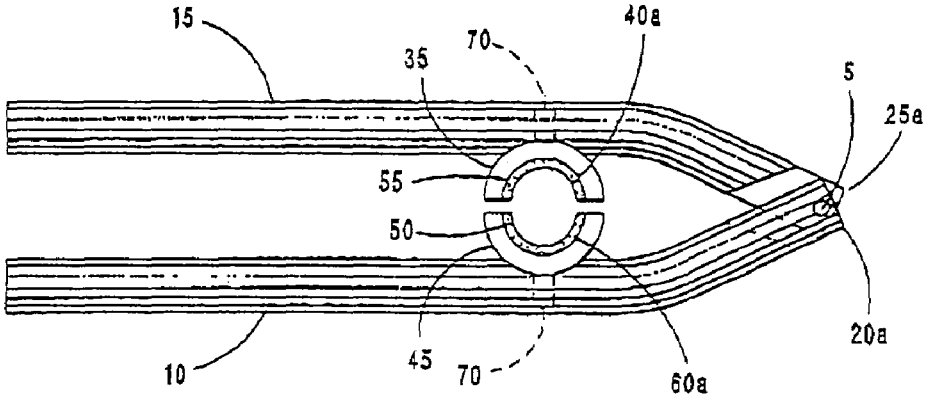
FIG. 1C is a lateral or side view of a slightly different and somewhat smaller embodiment of the arrow extractor of the invention.

FIG. 1C is a side view of a slightly different embodiment of the arrow extractor of the invention having basically somewhat smaller dimensions so as to be easily grippable with only one hand and having the clamp or gripping sections secured by a separate fastening 70 of any suitable form extending through the metal of the lever arm to secure the clamp section to the lever arm. The two lever arms are also essentially square or cut off with respect to their ends 20A and 25A on the lever arm 10 and 15 respectively. In addition it will be noted that in this embodiment the two clamp sections 35 and 45 do not completely close when the lever arms are parallel. Leaving some clearance between the clamp sections prevents the clamp from not solidly contacting the surface of a slightly undersized or out of round arrow shaft. The groove liners 40A and 60A will also be noted to be thinner than in the embodiment shown in FIG. 1A.

Figure 1D:
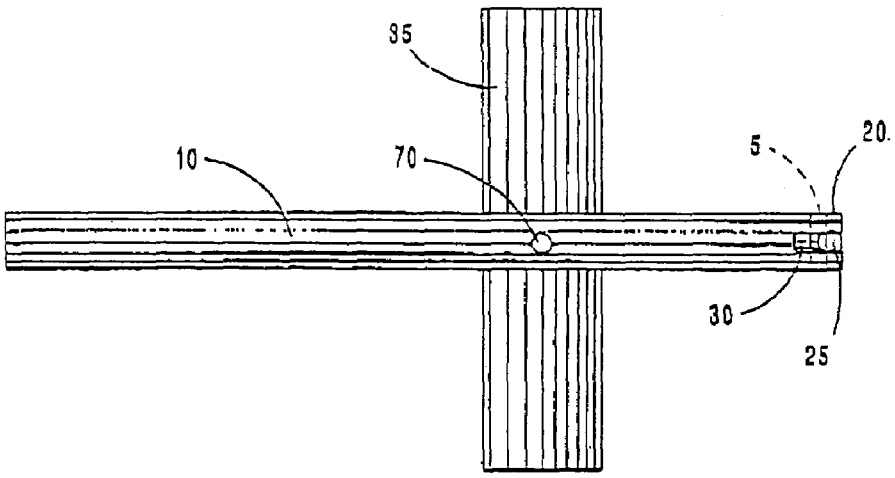
FIG. 1D is a plan or top view of the embodiment of the arrow extractor shown in FIG. 1C.

FIG. 1D is a top view of the arrow extractor tool embodiment shown in FIG. 1C and shows the separate fastening 70 which can be, as indicated above, of any suitable type such as a screw fitting, rivet, bolt or other fastening as understood by those skilled in the art.

FIG. 2A is a plan view of the arrow extractor of the present invention as shown in FIGS. 1A, 1B and 2A in a fully open position showing the gripping side of the two arrow grippers, or clamp sections, 35 and 45 and depicts the first lever arm 10 with its female hinge fork 20, first arrow shaft gripper, or clamp section, 35 and first clamp section liner 55. Also shown is the second lever arm 15 with its male hinge protrusion 25, recess 30, second arrow shaft gripper 45 and second groove liner 60.

FIG. 2B is a fully open view of the arrow extractor of the invention as shown in FIGS. 1A, 1B, and 2A showing the back of the lever arms 10 and 15 and the arrow grippers 35 and 45. It will be noted that the length of the recess 30 and male hinge protrusion are not as extended in this view since the lever arms 10 and 15 do not need to approach each other on this side as they must on the opposite side.

Figure 2C:
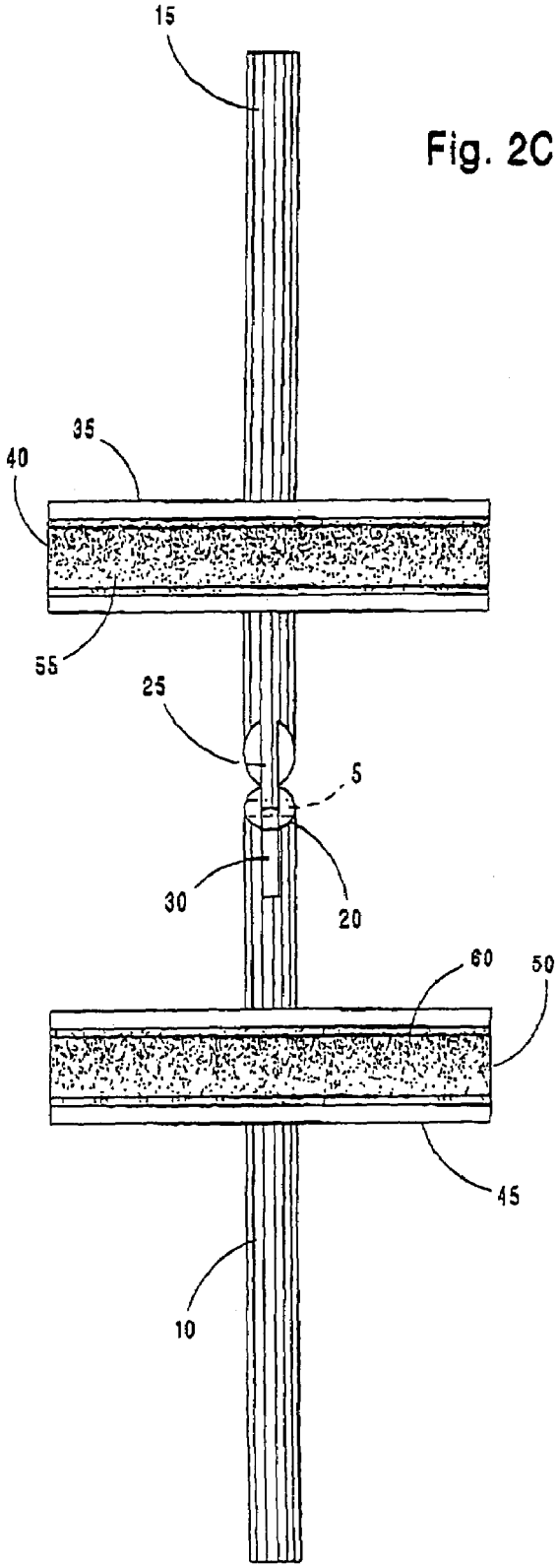
FIG. 2C is a top or plan view of the embodiment of the invention shown in FIGS. 1C and 1D laid out in a fully open position.

FIG. 2C is a plan view of the embodiment of the arrow extractor as shown in FIGS. 1C and 1D shown in FIG. 2C in a fully open position showing the gripping side of the two arrow grippers, or clamp sections 35 and 45. As indicated the dimensions of the arrow extractor embodiment are somewhat smaller than the embodiment shown in FIGS. 1A, 1B, 2A and 2B, which facilitates handling the arrow extractor device with one hand. Using one hand usually aids or facilitates keeping the arrow extracting tool straight during use and thus minimizing uneven lateral forces on the arrow shaft which could fracture the shaft or break the arrow.

Figure 2D:
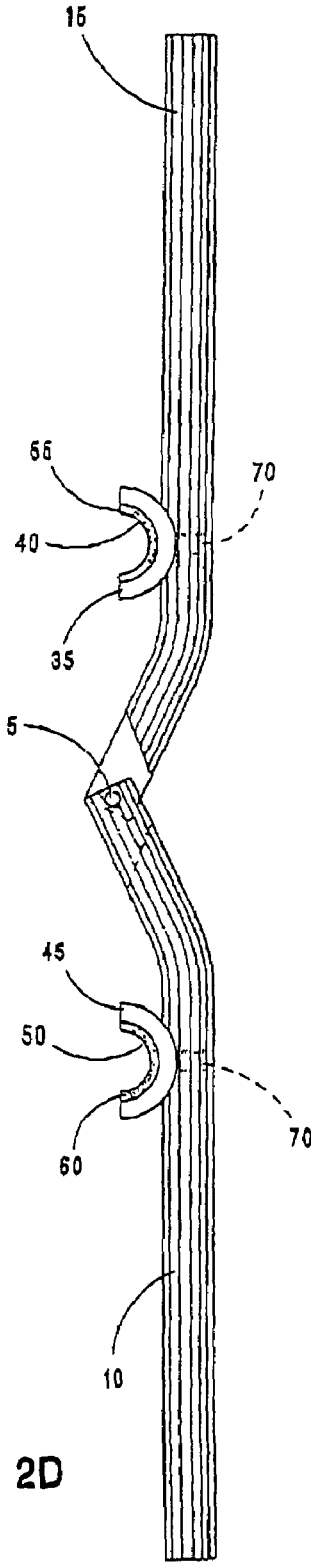
FIG. 2D is a side view of the embodiment of the invention show in FIGS. 1C, 1D, and 2C laid out in fully open configuration as in FIG. 2C.

FIG. 2D is a side view of the arrow extractor as shown in FIG. 2C which, as indicated above, is the same as that shown in FIGS. 1C and 1D. The arrow extractor is shown in FIG. 2D from the side opened completely out. It can be seen in FIG. 2D that the arrow grippers, or clamp sections 35 and 45 are partly inset into the lever arms 15 and 10 respectively. Such partial insetting of the half-circular clamp sections serve in combination with the fastenings 70 to fix the clamp sections in place on the lever arms 10 and 15. The square end section of the lever arm section adjacent to the pivot 5 in FIG. 2D can also be seen, plus the relative thinness of the linings 55 and 65 of the clamp sections 35 and 45 respectively.

Figure 3:
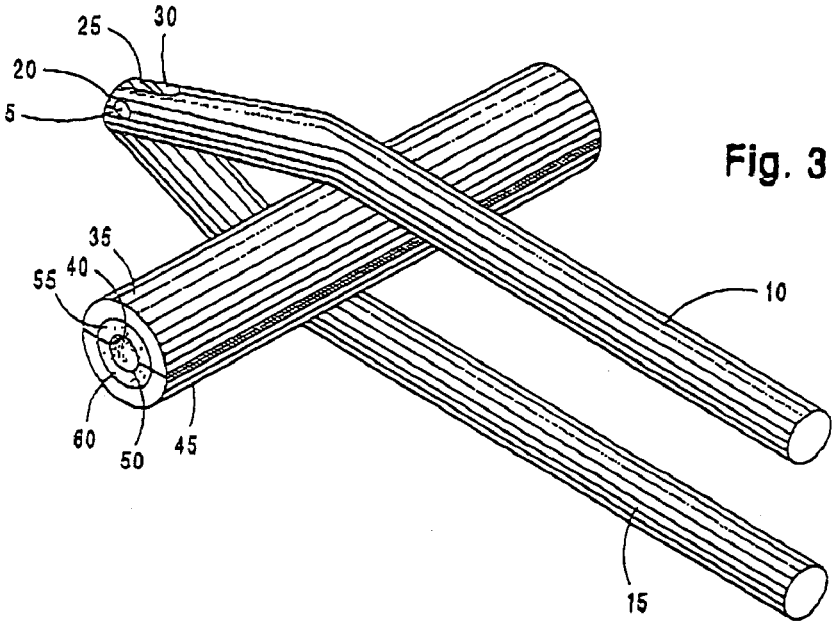
FIG. 3 is an isometric view of the arrow extractor of the invention in the embodiment of FIGS. 1A and 1B in a closed position without being applied to the shaft of an arrow.

Referring to FIG. 3, which is an isometric side view of the invention as shown in FIGS. 1A, 1B, 2A, and 2B shown in FIG. 3, in a closed position, with the first lever arm 10, having a female hinge fork 20 at one end, being shown above the second lever arm 15 and its corresponding male hinge protrusion 25. The male hinge protrusion 25 is fitted in the female hinge fork 20. The hinge pin 5 retains the first lever arm 10 in the second lever arm 15 and thus results in a device having a V-shaped frame at the pivoting end. A recess 30 or grooved area surrounds the male hinge protrusion 25 of the second lever arm 15 such that the lever arms may as explained above be fully opened 180-degrees without interference in the hinge.

Figure 3A:
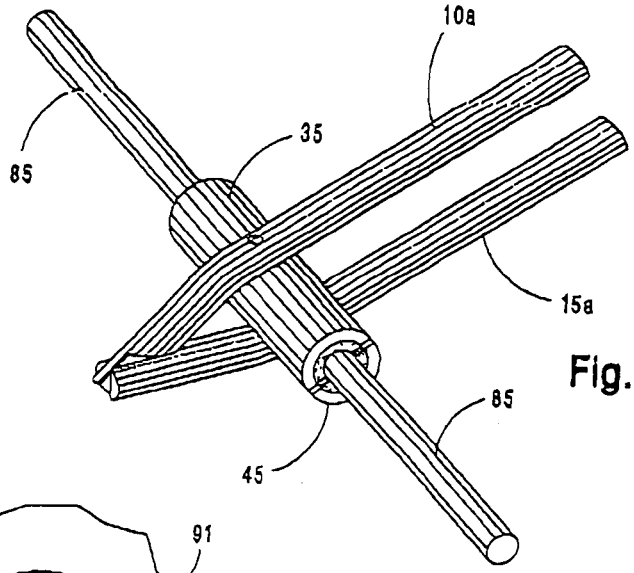
FIG. 3A is an isometric view of the embodiment of the invention shown in FIGS. 1C, 1D, 2C, and 2D closed about an arrow shaft omitting the arrow head and tail of the arrow.

FIG. 3A which is similar to FIG. 3 except that a section of an arrow shaft is shown in or between the clamp sections 35 and 45, which are furthermore not in contact with each other except through a section of arrow shaft 85 between the two clamp sections; this being the embodiment of the invention shown in FIGS. 1C, 1D, 2C, and 2D in which the dimensions of the overall arrow extractor are less than in the embodiment shown in FIGS. 1A, 1B, 2A, and 2B as well as FIG. 3. As indicated above, the fact that the two clamp sections do not normally contact ensures that an undersized or out of round arrow shaft will still be securely clamped between the arrow gripping or clamp sections 35A and 45A.

Figure 3B:
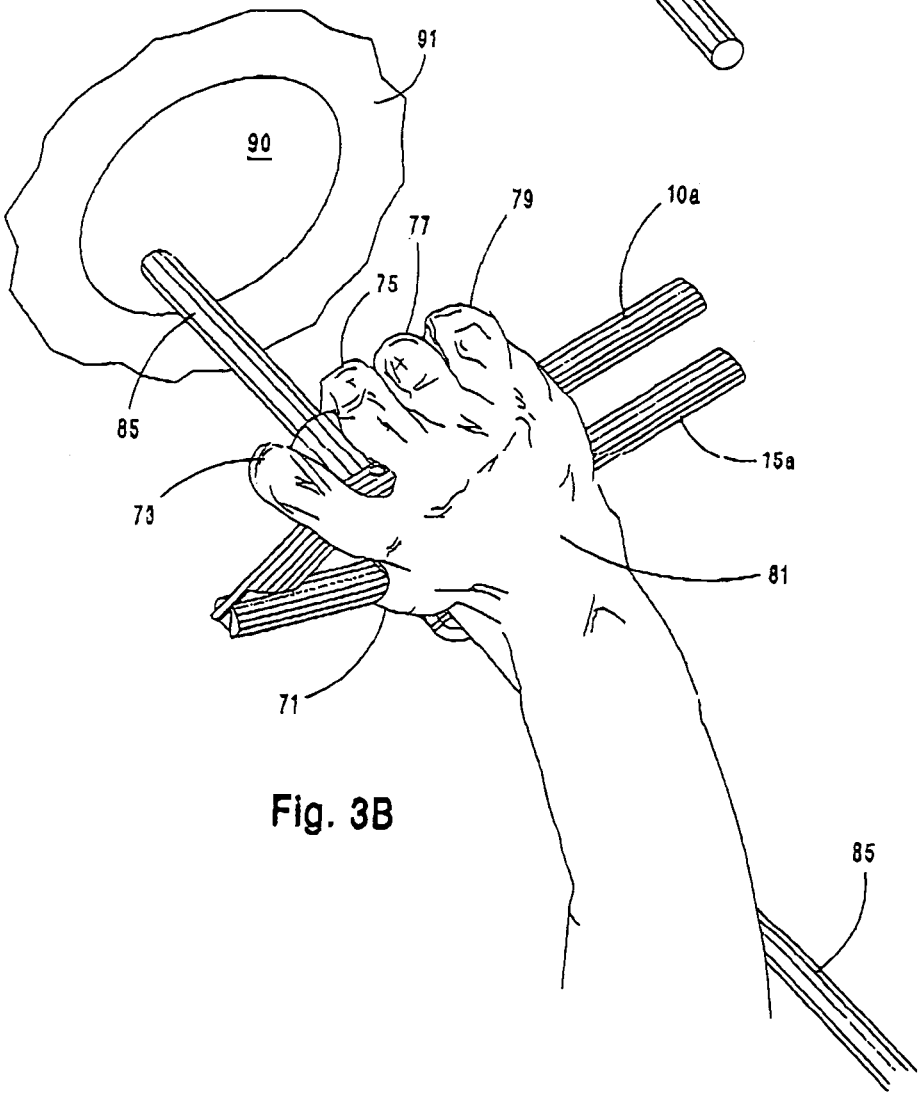
FIG. 3B is an isometric view of the embodiment of the invention a shown in FIG. 3A illustrating a hand of an archer holding the extracting tool of the invention in a preferred grip allowing both rearward and twisting force to be applied to the arrow shaft.

FIG. 3B shows the same arrow extractor shown in FIG. 3A being held in a preferred hand grip for the apparatus in which the thumb 71 and forefinger 73 of a hand 81 grips the pivot end of the arrow extractor and the middle, third, and small fingers reference numbers 75, 77, and 79, grip the outer end of the lever arms with the clamp sections 35–45 between the index and middle fingers as shown. This provides a secure powerful grip upon the arrow extractor and allows a powerful straight back force to be applied to the arrow extractor and through it to the arrow shaft 85 which is shown partially embedded within a portion 90 of a target 91.

Figure 4:
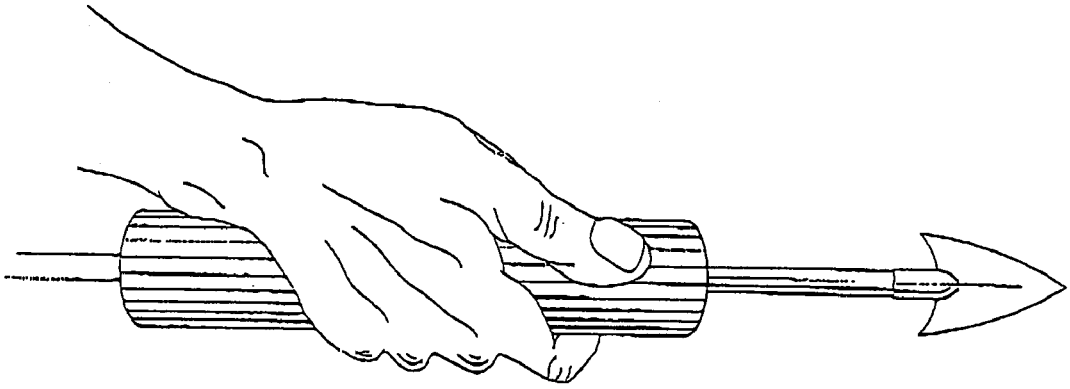
Fig. 4 PRIOR ART
FIG. 4 is an isometric view of the closest prior art arrow puller closed about an arrow.

FIG. 4 depicts a view of probably the most relevant prior art patent in the field of the invention. i.e. the Bulot U.S. Pat. No. 5,546,601, being a tool or device for gripping an arrow shaft in the palm of one's hand between two half round grooved clamping pieces such that the arrow may be pulled from its target. Prior art devices generally comprise at least one elongated grip member also having a shaped groove cut lengthwise therein. The Bulot device in operation is fitted around an arrow so that the arrow shaft will lie within the grove. The device is squeezed as clamping or pulling force is applied to the arrow while two half round clamping pieces for clamping the shaft of the arrow about the shaft in accordance with Bulot. However, there is no leverage or system for increasing the pressure between the half round clamping pieces, and consequently no leverage against the arrow shaft. Also, because prior art devices have no leverage for increasing the griping action against the arrow shaft, prior art devices do not enable the turning action required in dislodging an arrow from a foam practice target where the area in the target surrounding the arrow shaft is melted and refrozen about the arrow shaft.

Another disadvantage of the prior art is that not only is there no leverage system provided to grip the arrow shaft but a puller's bent wrist will be subject to the force used in dislodging or pulling the arrow. Such force may be likely to injure the puller by placing strain upon and possibly damaging his or her wrist joint.

Another disadvantage of the prior art is a resulting multidirectional force applied to the shaft of the arrow. Using a tool in the prior art, it is difficult, if not impossible, to apply the force necessary to dislodge the arrow only in the single direction and without applying any lateral or bending force that may break the arrow shaft. This problem is amplified in an arrow having a carbon fiber shaft because carbon fiber arrows are more delicate than conventional arrows.

Figure 5:
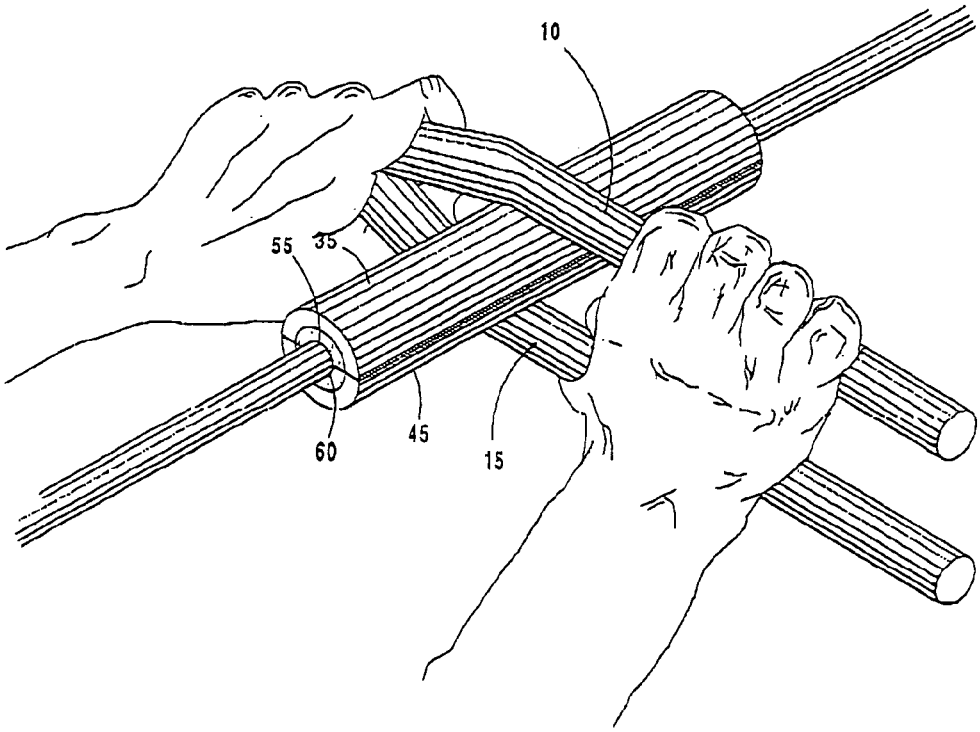
FIG. 5 is an isometric view showing the arrow puller of the present invention as shown in FIG. 3 closed about an arrow shaft with the hands of an operator gripping the arrow extracting tool to place an even twisting motion on the arrow if necessary followed by a straight pull to the rear particularly when pulling an arrow from an unintended target, such as a tree stump where considerable backward force may be necessary.

Referring to FIG. 5, there is shown an isometric view of the arrow extractor of the present invention fully closed about an arrow shaft during the use of the present invention. Such arrow extractor is shown as the embodiment shown in FIGS. 1A, 1B, and 3, which may be somewhat larger than other embodiments. The user fits the arrow extractor of the invention upon the shaft of either an embedded or partially embedded arrow in a manner such that the arrow shaft will lie within first and second groove liner 55, 60 of the first and second shaft grippers 35, 45. The user then grasps the hinge end of the invention with one hand, and simultaneously grasps the first and second lever arms 10, 15 using the opposite hand. The user then applies a closing force upon the first and second lever arms 10 and 15 by the appropriate hand such that the device will clamp upon the arrow shaft, after which the user may pull the arrow from its embedded location by a steady backward pull or force. As the arrow is gripped by the device, the user may turn the device ¼ to ½ turns in either direction to break the arrow free from any melted or frozen area as may be desired in dislodging an arrow from a foam practice target where the area in the target surrounding the arrow shaft is melted and resolidified or frozen about the arrow shaft. Since the lever arms 10 and 15 enable a very effective clamping action to be applied to the arrow shaft as much rearward pull or force may be applied to the arrow as is necessary to withdraw it from the target.

Figure 6:
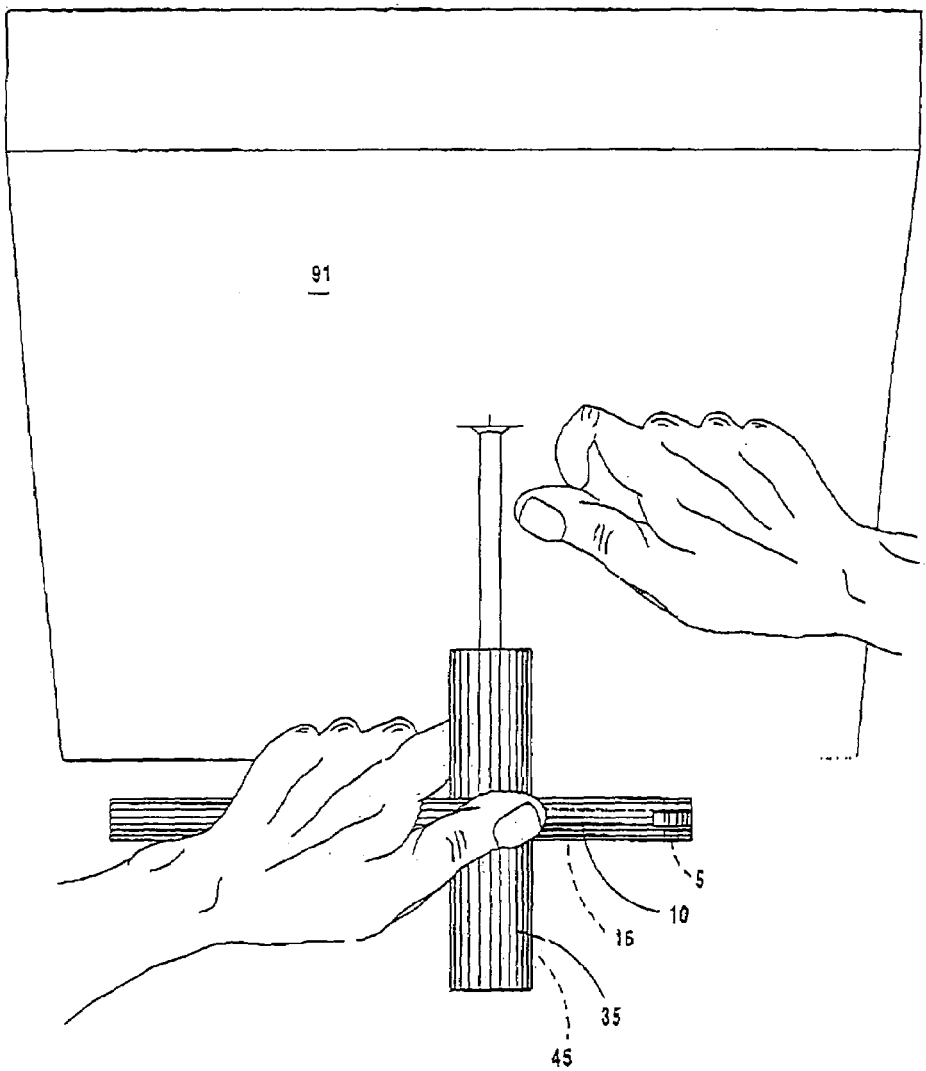
FIG. 6 is an isometric view showing the present invention and its use in pulling an arrow from an intended target, such as a foam practice target where the area in the target surrounding the arrow shaft is melted or frozen about the arrow shaft and an initial twisting followed by a straight pull to the rear plus a simultaneous support of the target with one hand may be necessary.

Referring to FIG. 6, an alternative manner of use of the present invention is shown wherein the user grasps the body of the invention with one hand, and simultaneously grasps the first and second lever arms 10, 15 using the same hand. This allows the user to push against or steady the target 91 with his or her opposite hand while simultaneously clamping and retrieving the arrow from the target. The user will, of course, grip the arrow extractor in any manner which is comfortable for the user and applies a strong rearward force. However, the design of the extractor considerably facilitates the application of a strong rearward force.

In both FIGS. 5 and 6 the dimensions of the arrow extractor of the invention plus the arrow shaft are relatively expanded relative to the dimensions of the gripping hands illustrated with the arrow extractor in order to better illustrate the construction and arrangement of the arrow extractor. Because of the relatively small dimensions of the extractor, full-scale hands shown with it would tend to obscure portions thereof.

Several advantages of the present invention over the prior art will become evident to one skilled in the art. First, in using the device of the present invention, a puller's pulling wrist can remain straight and thereby the likelihood of injury to the wrist joint is reduced. Second, because two hands may be used to grasp and dislodge the arrow, more force can be applied to dislodge the arrow using the present invention than in using the devices of the prior art. Furthermore, the lever arms 10 and 15 serve to clamp the grips 35 and 45 about the arrow shaft more effectively and securely and allow a more uniform force to be applied to such arrow shaft. Third, the configuration of the arrow extractor of the present invention minimizes lateral and bending forces along the arrow shaft and therefore reduces the likelihood of arrow breakage. This is particularly true in the embodiment and method of holding the arrow extractor shown in FIG. 3B.

The arrow puller of the invention is simple and compact, being in a preferred form about 5 to 6 inches long along the lever arms 15 from the pivot 5 to the outer end of, the handle, with the arrow grippers 35 and 40 being positioned about 1.75 to 2 inches from the pivot. This provides a compact easily manipulated tool that can also easily be slipped into a pocket or stored in an unobtrusive holder or holster on a user's belt, which arrow extractor is also easily maneuvered by both a small to medium sized male hand or the average female hand. However, for a large hand a total length of 6 to 8 inches may be more comfortable or suitable. A relatively small size, as indicated, is desirable to make the device easy and convenient to carry and is usually sufficient to place enough tension on an arrow to allow it to be easily extracted without damage from the usual target.

Since, as illustrated, it is convenient to be able to use both hands to apply backward force upon a deeply embedded arrow to extract it, one improvement of the invention may be a handle extension from the pivoted end. Such handle section will in most cases comprise an extension from one lever arm extending straight forward, but also could comprise two extensions, one from each handle or gripper section, which extensions mesh or come close together when the grippers are closed upon an arrow. Since one advantage of the device of the invention is its relatively small size and light weight, it may be desirable to form any such forward handle pair, or single handle foldable to reduce the overall length of the arrow puller of the invention when not in use. Likewise, the long end of the lever arms or handle may be made foldable for compactness to facilitate carrying in one's pocket or in a belt carrier or the like. In most cases a single hand grip on a small extractor as shown in FIG. 3B which facilitates both rotation of the arrow in the target and a straight rearward away from the target will be satisfactory.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A method of gripping and extracting a lightweight aluminum or carbon fiber arrow from a foam target with an arrow gripper and extractor, said arrow gripper and extractor comprising: a first lever arm having a first end and a second end, and being configured to be gripped by a user; said first lever arm comprising a first elongated arrow gripping portion; said first elongated arrow gripping portion being disposed substantially perpendicularly to said first lever arm, and extending substantially equally on both sides of said first lever arm; a second lever arm having a first end and a second end, and being configured to be gripped by a user; said second lever arm comprising a second elongated arrow gripping portion; said second elongated arrow gripping portion being disposed substantially perpendicularly to said second lever arm, and extending substantially equally on both sides of said second lever arm; each of said first and second elongated arrow gripping portions comprising a clamp section; each of said clamp sections having matching surface recesses and being configured to substantially closely surround the shaft of a lightweight aluminum or carbon fiber arrow; each of said clamp sections comprising a resilient gripping material being configured and disposed to grip a lightweight aluminum or carbon fiber arrow; said first lever arm and said second lever arm being substantially equal in length, and being configured and disposed to meet at a common pivot point at said first end of each of said first lever arm and said second lever arm; said first lever arm and said second lever arm, in conjunction with said arrow gripper, being sufficiently long to keep a user's hands away from the arrow head of the lightweight aluminum or carbon fiber arrow, to substantially minimize injury to the user's hands by the arrow head; said first elongated arrow gripping portion and said second elongated arrow gripping portion being disposed a substantial distance from said second end of said first and second lever arms, and being disposed substantially closer to said first end of said first and second lever arms than said second end of said first and second lever arms; said pivot point comprising a hinge and being configured to permit said first elongated arrow gripping portion and said second elongated arrow gripping portion to come into contact and to form an arrow gripper; said arrow gripper being substantially longer than said first and second lever arms are wide, and being configured to have the dimensions to grip a lightweight aluminum or carbon fiber arrow shaft; said arrow gripper being configured to grip on a lightweight aluminum or carbon fiber arrow along a substantial portion of its arrow shaft that is extending from a foam target, to evenly and linearly distribute a grasping force over a substantial portion of the arrow shaft, and being configured to minimize bending forces, which bending forces may break a lightweight aluminum or carbon fiber arrow shaft; said first lever arm comprising a forked end and said second lever arm comprising a protrusion, wherein said pivot point for connecting said first lever arm to said second lever arm is a hinge pin retaining said protrusion within said forked end; and said first and second lever arms and said arrow gripper being configured to be pulled by a user in order to pull an embedded lightweight aluminum or carbon fiber arrow out of a foam target to remove the lightweight aluminum or carbon fiber arrow when the foam target has melted around the arrow, or when frost has frozen around the arrow, to substantially minimize breaking of the arrow shaft or the arrow head of the lightweight aluminum or carbon fiber arrow, said method comprising the steps of:

opening said arrow gripper and extractor by pivoting said first and second lever arms away from one another;

placing said first elongated arrow gripping portion about the shaft of a lightweight aluminum or carbon fiber arrow that is deeply embedded in a foam target, where the entire head of the arrow and at least a portion of the shaft is embedded in the foam target, and when the foam target has melted and resolidified around the arrow, or when frost has frozen around the arrow;

closing said arrow gripper and extractor on the embedded lightweight aluminum or carbon fiber arrow by pivoting said first and second lever arms toward one another;

enclosing and clamping and gripping a substantial portion of the lightweight aluminum or carbon fiber arrow shaft in said arrow gripper such that the lightweight aluminum or carbon fiber arrow rests in and compresses said resilient gripping material about a substantial portion of the lightweight aluminum or carbon fiber arrow, and such that the lightweight aluminum or carbon fiber arrow is disposed substantially perpendicularly to said first and second lever arms;

gripping said first and second lever arms with the hands of the user while maintaining the hands of the user away from the arrow head, and applying a force to evenly and linearly distribute a grasping force over a substantial portion of the lightweight aluminum or carbon fiber arrow shaft in order to minimize bending forces which may break a lightweight aluminum or carbon fiber arrow shaft;

turning the lightweight aluminum or carbon fiber arrow in a clockwise or counterclockwise direction about the longitudinal axis of the shaft of the arrow by applying a rotational force to said first and second lever arms to loosen or break the lightweight aluminum or carbon fiber arrow free from a stuck or frozen position within the foam target in order to minimize damage to the arrow;

pulling the embedded lightweight aluminum or carbon fiber arrow out of the foam target with said arrow gripper and extractor in a direction substantially parallel to the longitudinal axis of the shaft of the arrow while substantially minimizing damage to the arrow; and opening said arrow gripper and extractor and removing the extracted lightweight aluminum or carbon fiber arrow from said arrow gripper and extractor to permit further use of the extracted lightweight aluminum or carbon fiber arrow by a user.

2. The method of gripping and extracting an arrow from a foam target according to claim 1, wherein said first and second elongated arrow gripping portions are positioned on said first and second lever arms a distance from said pivot point of between approximately one quarter and one third of the distance from said pivot point to said second ends of said first and second lever arms, and wherein said step of enclosing and clamping and gripping a substantial portion of an arrow shaft in said arrow gripper comprises enclosing and clamping and gripping a substantial portion of an arrow shaft at a position a distance from said pivot point of between approximately one quarter and one third of the distance from said pivot point to said second ends of said first and second lever arms.

3. The method of gripping and extracting an arrow from a foam target according to claim 2, wherein said first elongated arrow gripping portion and said second elongated arrow gripping portion are not less than two inches each in length nor more than 5 inches each in length and the length of said second elongated arrow gripping portion is substantially equal to the length of said first elongated arrow gripping portion, and wherein said step of enclosing and clamping and gripping a substantial portion of an arrow shaft in said arrow gripper comprises enclosing and clamping and gripping a substantial portion which is not less than two inches in length nor more than 5 inches in length.

4. The method of gripping and extracting an arrow from a foam target according to claim 3, wherein the length of said first lever arm and said second lever arm is at least 5 inches, and wherein said step of closing said arrow gripper and extractor on the embedded lightweight aluminum or carbon fiber arrow by pivoting said first and second lever arms toward one another comprises closing said arrow gripper and extractor on the embedded lightweight aluminum or carbon fiber arrow by pivoting said first and second at-least-five-inch lever arms toward one another.

5. The method of gripping and extracting an arrow from a foam target according to claim 4, wherein the length of said first lever arm is no more than 8 inches, and wherein said step of closing said arrow gripper and extractor on the embedded lightweight aluminum or carbon fiber arrow by pivoting said first and second at-least-five-inch lever arms toward one another comprises closing said arrow gripper and extractor on the embedded lightweight aluminum or carbon fiber arrow by pivoting said first and second at-least-five-and-no-more-than-eight-inch lever arms toward one another.

6. The method of gripping and extracting an arrow from a foam target according to claim 5, wherein said first elongated arrow gripping portion is attached to said first lever arm at a position a distance from said first end of no less than ¼ the overall length of said first lever arm, and said second elongated arrow gripping portion is attached to said second lever arm at the point corresponding to the attachment of said first elongated arrow gripping portion on said first lever arm, and wherein said step of enclosing and clamping and gripping a substantial portion of an arrow shaft in said arrow gripper comprises enclosing and clamping and gripping a substantial portion of an arrow shaft at a position a distance from said first end of no less than ¼ the overall length of said first or second lever arm.

* * * * *